US008037947B2

(12) United States Patent
Miwa

(10) Patent No.: US 8,037,947 B2
(45) Date of Patent: Oct. 18, 2011

(54) IMPACT TOOL WITH SHOCK ABSORBING ELEMENT

(75) Inventor: Masao Miwa, Anjo (JP)

(73) Assignee: Makita Corporation, Anjo-shi (JP)

( * ) Notice: Subject to any disclaimer, the term of this patent is extended or adjusted under 35 U.S.C. 154(b) by 194 days.

(21) Appl. No.: 12/379,590

(22) Filed: Feb. 25, 2009

(65) Prior Publication Data

US 2009/0242223 A1 Oct. 1, 2009

(30) Foreign Application Priority Data

Mar. 28, 2008 (JP) ..... 2008-087629

(51) Int. Cl.
*B25D 11/00* (2006.01)
*B25D 17/24* (2006.01)

(52) U.S. Cl. ..... 173/210; 173/162.1; 173/162.2; 173/211; 173/212; 173/200; 173/204; 173/128

(58) Field of Classification Search ..... 173/162.1, 173/162.2, 210–212, 200, 204, 128; 278/19, 278/19.7
See application file for complete search history.

(56) References Cited

U.S. PATENT DOCUMENTS

| | | | | |
|---|---|---|---|---|
| 2,337,351 | A * | 12/1943 | Schorer | 173/138 |
| 4,476,941 | A * | 10/1984 | Buck et al. | 173/117 |
| 5,871,059 | A * | 2/1999 | Shibata et al. | 173/211 |
| 5,996,708 | A * | 12/1999 | Gerold | 173/211 |
| 6,467,555 | B2 * | 10/2002 | Plank et al. | 173/201 |
| 6,644,418 | B2 * | 11/2003 | Haga | 173/48 |
| 6,732,815 | B2 * | 5/2004 | Hanke et al. | 173/201 |
| 6,948,571 | B2 * | 9/2005 | Hanke et al. | 173/201 |
| 7,445,054 | B2 * | 11/2008 | Heep et al. | 173/48 |
| 2008/0006426 | A1 * | 1/2008 | Friedrich et al. | 173/210 |

FOREIGN PATENT DOCUMENTS

| | | |
|---|---|---|
| BE | 440894 A | 4/1941 |
| DE | 196 07 329 A1 | 8/1996 |
| EP | 0 218 547 A | 4/1987 |
| EP | 1 886 767 A2 | 2/2008 |
| GB | 2 084 917 A | 4/1982 |
| JP | A-01-240278 | 9/1989 |
| JP | A-2001-179657 | 7/2001 |
| JP | A-2004-106136 | 4/2004 |

* cited by examiner

*Primary Examiner* — Rinaldi I. Rada
*Assistant Examiner* — Michelle Lopez
(74) *Attorney, Agent, or Firm* — Oliff & Berridge, PLC

(57) ABSTRACT

A shock-absorbing element is disposed frontward of an interjacent element within a housing of an impact tool, and a washer is disposed rearward of and adjacent to the shock-absorbing element. The interjacent element is configured to come in contact with the washer when the interjacent element is caused to advance by an impactor's strike under no-load conditions. A sleeve disposed rearward of and adjacent to the washer is configured to position the shock-absorbing element and the washer, and to allow the interjacent element to move rearward and frontward inside the sleeve.

12 Claims, 2 Drawing Sheets

IMPACT TOOL WITH SHOCK ABSORBING ELEMENT

BACKGROUND OF THE INVENTION

This application claims the entire benefit of Japanese Patent Application Number 2008-087629 filed on Mar. 28, 2008, the entirety of which is incorporated by reference.

TECHNICAL FIELD

This invention relates to an impact tool such as an electric hammer, a hammer drill, etc.

BACKGROUND ART

Electric hammers or other impact tools of a particular type are known in the art, such that a cylindrical housing of which a front end is adapted to receive a bit houses a cylinder provided in a rear space inside the housing and an interjacent element provided between the cylinder and the bit as installed at the front end. The cylinder incorporates a motor-driven reciprocating piston and an impactor that is provided frontward of the piston and configured to be moved in synchronization with the piston. The interjacent element is configured to be movable rearward and frontward in a predetermined stroke, and to be pressed rearward into a retreated position by a rear end of the bit when the bit is installed. Accordingly, the impactor reciprocating in synchronization with the piston strikes the interjacent element which indirectly strikes the bit.

In this type of impact tool, when no load is applied thereto (i.e., when the bit is not installed, or when the bit is installed and the front end thereof is not brought into contact with a target object so that it can move rearward and frontward relative to the housing), the impactor making a lost motion strikes the interjacent element which in turn advances to come in contact with a stepped portion formed (at a position of the stroke end) on an inner surface of the housing, thus causing a noise and/or an impact. At this time, the interjacent element may bounce off the stepped portion and be struck again by the impactor, which may make the interjacent element repeatedly come in contact with the stepped portion. Such useless striking motions of the impactor would disadvantageously lower the durability of the housing or the components such as bolts. With this in view, it has been proposed as disclosed in JP 2001-179657 A and JP 1-240278 A that a shock-absorbing element made of rubber or the like should be provided on the stepped portion proactively to reduce the impact caused by the interjacent element due to the lost motion of the impactor.

However, even in such an improved structure with a shock-absorbing element provided on the stepped portion, the shock-absorbing element, instead, with which the interjacent element will come in contact may probably deteriorate progressively. It is to be noted that the shock-absorbing element made of rubber or the like is press-fitted in a recess formed at the stepped portion in many instances, and is thus stressed more by a combination of the compressive load imposed axially by the interjacent element which comes in contact with the shock-absorbing element, with the compressive load imposed from the recess in which the shock-absorbing element is press-fitted; the combined stresses imposed as such should inevitably lower the durability of the shock-absorbing element.

Thus, there is a need to provide an impact tool which includes a shock-absorbing element with its durability increased to maintain the performance for a longer period of time.

The present invention has been made in an attempt to eliminate the above disadvantages, and illustrative, non-limiting embodiments of the present invention may overcome the above disadvantages and other disadvantages not described above.

SUMMARY OF INVENTION

It is an aspect of the present invention to provide an impact tool which comprises: a cylindrical housing having a bit-installable end; a cylinder provided in a rear space within the housing, the cylinder incorporating a motor-driven reciprocating piston and an impactor that is provided frontward of the piston and configured to be moved in synchronization with the piston; an interjacent element provided within the housing between the cylinder and a bit as installed at the bit-installable end of the housing, and configured to be movable rearward and frontward in a predetermined stroke and to be pressed rearward into a retreated position by a rear end of a bit when the bit is installed, wherein the impactor reciprocating in synchronization with the piston is configured to strike the interjacent element so that the bit is indirectly struck by means of the interjacent element; a shock-absorbing element disposed frontward of the interjacent element within the housing; a washer disposed rearward of the shock-absorbing element and adjacent to the shock-absorbing element, wherein the interjacent element is configured to come in contact with the washer when the interjacent element is caused to advance by the impactor's strike under no-load conditions; and a sleeve disposed rearward of and adjacent to the washer, wherein the sleeve is configured to position the shock-absorbing element and the washer, and to allow the interjacent element to move rearward and frontward inside the sleeve.

The impact tool configured as described above may further comprise a second shock-absorbing element disposed between the sleeve and the cylinder such that the impactor advancing under no-load conditions strikes the second shock-absorbing element (directly or indirectly), wherein the second shock-absorbing element is configured to position a rear end of the sleeve directly or indirectly. This additional feature can serve to effectively achieve proper positioning of the sleeve.

In the impact tool configured as described above in the first aspect, with or without the additional feature described in the second aspect, an inner surface of the sleeve may be configured to serve as a guide surface on which the interjacent element is slidable. This additional feature can serve to stably hold the interjacent element by effectively utilizing the sleeve.

In the impact tool configured as described above in the first aspect, a rear end of the bit passes through the washer when the bit is installed into the housing, so that a rear-end portion of the bit is held by the washer. This additional feature can serve to ensure the good striking performance by effectively utilizing the washer.

According to the configuration described above in the first aspect, the interjacent element is not directly brought into contact with the shock-absorbing element, and the shock-absorbing element is positioned by the sleeve without being press-fitted into a recess. Therefore, the stress imposed on the shock-absorbing element can be reduced, so that the durability can be increased to maintain the performance for a longer period of time.

According to the additional feature described above in the second aspect, the second shock-absorbing element can advantageously be utilized also for the positioning of the sleeve.

According to the additional feature described above in the third aspect, the sleeve can advantageously be utilized effectively for stably holding the interjacent element within the housing.

According to the additional feature described above in the fourth aspect, the washer can serve to stably hold the bit without causing the bit to wobble circumferentially around the axis of the bit. Therefore, the washer can be effectively utilized for maintaining the good striking performance of the bit.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DESCRIPTION OF EMBODIMENTS

Exemplary embodiments of the present invention will be described hereinafter with reference to the accompanying drawings.

Figure 1:
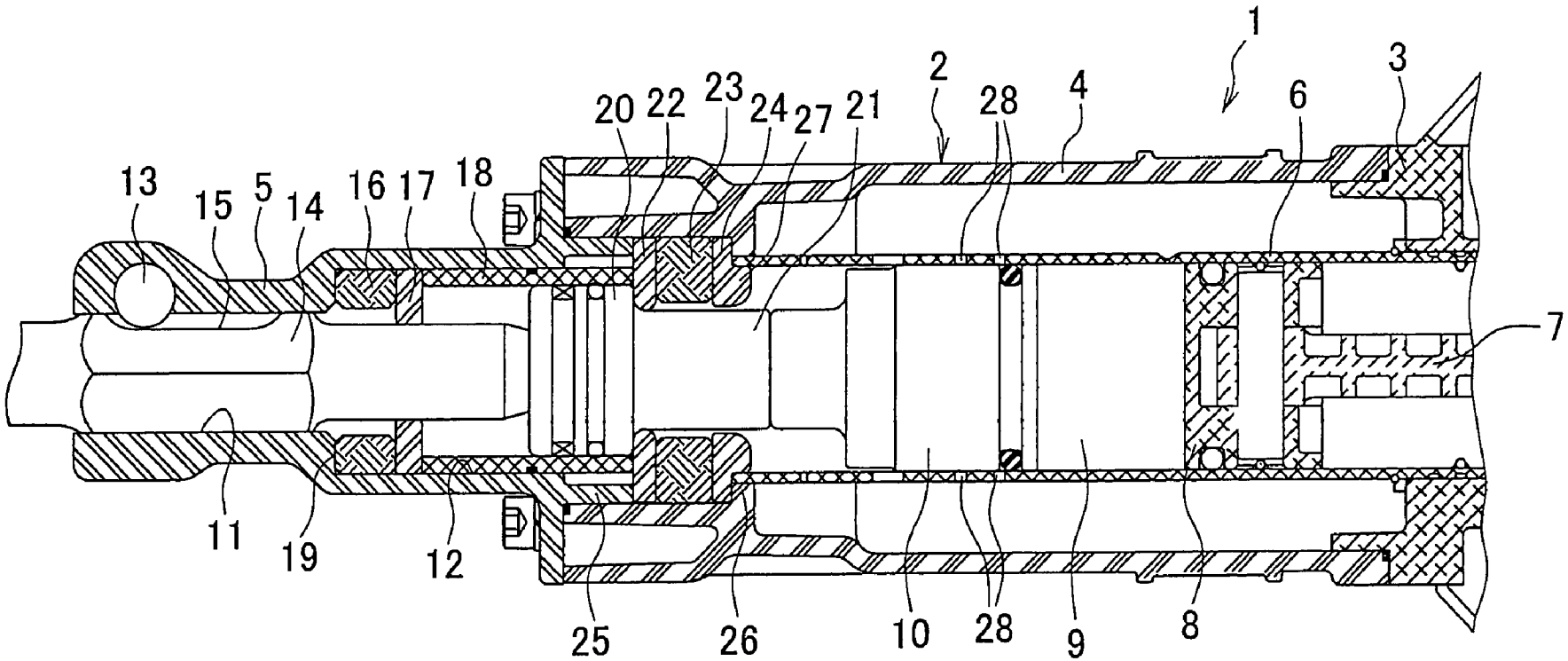
FIG. 1 is a partially illustrated vertical section of an electric hammer according to an exemplary embodiment of the present invention, during a normal striking operation.

In FIG. 1, a partial vertical section of an electric hammer as one example of an impact tool constructed in accordance with the present invention is shown, to illustrate the state during a normal striking operation thereof. In an electric hammer 1, a housing 2 comprises: a cylindrical barrel 4 coupled to a front end (left end shown at the light-hand area in FIG. 1) of a crank housing 3 which houses a motor (not shown); and a tool holder 5 coaxially coupled to a front end of the barrel 4.

In the barrel 4, a cylinder 6 is held coaxially with the barrel 4, and in the cylinder 6, a piston 8 coupled to a connecting rod 7 provided in a crank mechanism known in the art and an impactor 10 disposed frontward of the piston 8 are housed in the cylinder with an air chamber 9 interposed therebetween, in such a manner that the piston 8 and the impactor are movable frontward and rearward inside the cylinder 6.

The tool holder 5, on the other hand, has an inner surface shaped to provide a hexagonal hole 11 and a cylindrical hole 12 in front and rear portions of the tool holder 5, respectively. The cylindrical hole 12 is coaxial with and larger in diameter than the hexagonal hole 11 to form a stepped portion 19 at a joint part between the cylindrical hole 12 and the hexagonal hole 11. In the front portion where the hexagonal hole 11 is provided, a retainer 13 is attached to the tool holder 5, perpendicularly to an axial direction of the tool holder 5. The bit 14 has a recess 15 in a periphery extending in a front-and-rear direction, and the retainer 13 is configured to be fitted in the recess 15 being inserted in the hexagonal hole 11. Thus, the bit 14 is held in such a manner that the bit 14 can move frontward and rearward in a stroke that is defined by rear and front ends of the recess 15 which are brought into contact with the retainer 13 at its frontmost and rearmost positions, respectively.

In the cylindrical hole 12 of the tool holder 5, a cushion ring (shock-absorbing element) 16, a washer 17, and a sleeve 18 are inserted, from the front in this order, coaxially with one another. The cushion ring 16 is has a rectangular cross section and is made of rubber such as urethane rubber, and is in contact with the stepped portion 19 formed between the hexagonal hole 11 and the cylindrical hole 12. The washer 17 and the sleeve 18 are in contact with the frontwardly adjacent parts, respectively (i.e., washer 17 with cushion ring 16, and sleeve 18 with washer 17). Thus, frontward movement of the cushion ring 16, washer 17 and sleeve 18 is restricted by the stepped portion 19. An inside diameter of the washer 17 is defined such that a rear portion of the bit 14 is kept in contact with the washer 17 while passing through the washer 17, when the bit 14 is installed in the tool holder 5. An inside diameter of the sleeve 18 is larger than that of the washer 17, and an interjacent element 20 (more specifically, a front portion thereof) is housed inside the sleeve 18.

Between the sleeve 18 and the cylinder 6 inside the barrel 4, a front washer 22, a second cushion ring (second shock-absorbing element) 23 which has a substantially square cross section and is made of rubber such as urethane rubber, and a rear washer 24 are arranged adjacently in this order. The front washer 22 is in contact with a rear end portion 25 of the tool holder 5 that is inserted into a front end portion of the barrel 4 when the tool holder 5 is mounted to the barrel 4, so that the positioning of the front washer 22, second cushion ring 23 and rear washer 24 are made on the front. The rear washer 24 is in contact with a rib 26 formed circumferentially on an inner surface of the barrel 4, so that the positioning of the rear washer 24, second cushion ring 23 and front washer 22 are made on the rear. In this state, a rear end of the sleeve 18 is in contact with the front washer 22, and thus the sleeve 18 as well as the cushion ring 16 and the washer 17 is prevented from moving rearward. Thus, the cushion ring 16 is subjected to restrictions only on movement in the front-and-rear directions without being compressed in an axial direction. Further, at a rear face of the rear washer 24, an annular protrusion 27 is provided so as to have a front end portion of the cylinder 6 held between the annular protrusion 27 and the rib 26 and to protrude into the front end portion of the cylinder 6 to delimit a position at which an impactor 10 is prevented from advancing further.

The interjacent element 20 has a front portion with a diameter such that the front portion of the interjacent element 20 is slidable on an inner surface of the sleeve 18, and is configured to be movable rearward and frontward in a stroke delimited by the washer 17 and the front washer 22 with which the interjacent element is brought into contact at frontmost and rearmost positions thereof, respectively. The interjacent element 20 includes a shaft 21 which forms a rear portion of the interjacent element 20. The shaft 21 has a reduced diameter and is thus allowed to pass through the front and rear washers 22, 24 and the second cushion ring 23. When the interjacent element 20 is in the retreated position where the interjacent element 20 is in contact with the front washer 22, the shaft 21 protrudes through the front and rear washers 22, 24 and the second cushion ring 23 into the cylinder 6, as shown in FIG. 1, and thus, a front end of the reciprocating impactor 10 comes in contact with the shaft 21. On the other hand, the shaft 21 protrudes only through the front washer 22 (but fails to protrude into the cylinder 6), as shown in FIG. 2, when the interjacent element 20 is in an advanced position where the interjacent element 20 is in contact with the washer 17, so that the impactor 10 will never come in contact with the interjacent element 20 even when the impactor 10 reaches the frontmost advanced position where the interjacent element 20 is in contact with the protrusion 27 of the rear washer 24.

When the electric hammer 1 configured as described above with the bit 14 inserted in the hexagonal hole 11 of the tool holder 5 and held by the retainer 13 is manipulated so that the tip of the bit 14 is pressed against the ground or other target object, the rear end of the bit 14 which is being retreated protrudes through the washer 17 into the sleeve 18 as shown in FIG. 1, and pushes the interjacent element 20 back into the retreated position where the interjacent element 20 is in contact with the front washer 22. In this state, when the motor is activated and the piston 8 is actuated to reciprocate by the connecting rod 7, the impactor 10 reciprocates by the action of an air spring in the air chamber 9, and strikes the shaft 21 of the interjacent element 20 which is located inside the cylinder 6. In this way, the impactor 10 indirectly strikes the bit 14 by means of the interjacent element 20. In particular, according to the present embodiment, the rear end portion of the bit 14 is supported by the washer 17, and thus the bit 14 is stably held without wobbling.

Figure 2:
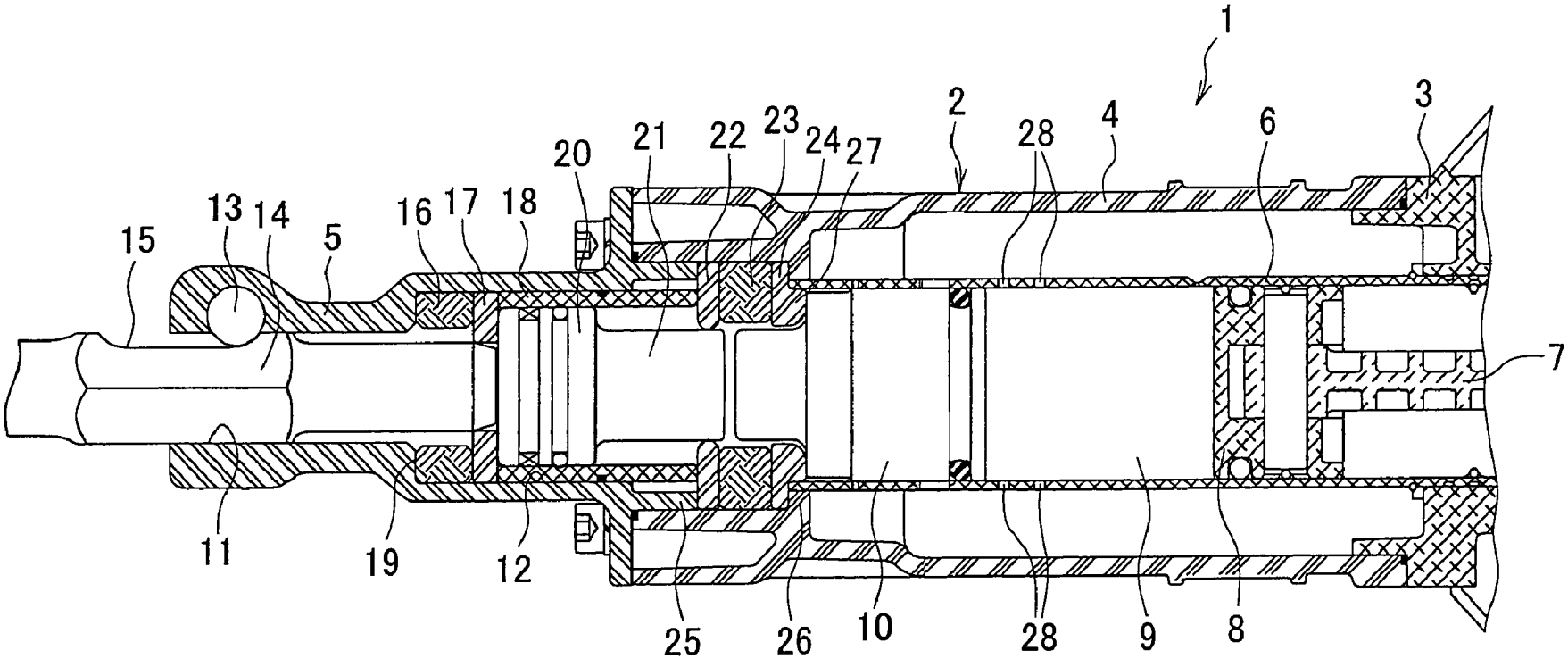
FIG. 2 is a partially illustrated vertical section of the electric hammer, during idle time when no load is applied thereto.

On the other hand, under no-load conditions, for example, when the electric hammer 1 is lifted up so that the tip of the bit 14 is suspended above the ground, the first lost motion of the impactor 10 forces the interjacent element 20 to advance to the advanced position where the interjacent element 20 is in contact with the washer 17, and forces the bit 14 to advance until the retainer 13 comes in contact with the rear end of the recess 15, as shown in FIG. 2. In this operation, the rear end of the bit 14 does not protrude rearward through the washer 17 into the sleeve 18. Therefore, the impact produced by the contact of the interjacent element 20 with the washer 17 is indirectly absorbed by the cushion ring 16 located frontward of the washer 17, with the result that the interjacent element 20 would not bounce back so much.

Although the impactor 10 making a lost motion advances and comes in contact with the rear washer 24, the impact or shock thus produced will be absorbed by the second cushion ring 23. On the other hand, the cylinder 6 has ventilating openings 28 configured to be closed by the periphery of the impactor 10 when the impactor 10 makes a normal reciprocating motion and to be open when the impactor 10 reaches the most advanced position where the impactor 10 is in contact with the rear washer 24. Thus, the action of air spring will be lost after the impactor 10 moves to the most advanced position because the air chamber 9 is then afforded communication with outside. Accordingly, continuous reciprocating motion of the piston 8 would not cause the impactor 10 to move in synchronization with the piston 8 any more.

It is to be understood that the operation under no-load conditions as described above would be similar to an operation in which the bit 14 is not installed in the tool holder 5. In other words, at the time of the first lost motion, the cushion ring 16 absorbs the impact of the interjacent element 20 and the second cushion ring 23 absorbs the impact of the impactor 10, and the another lost motion will be prevented.

As described above, in the electric hammer 1 according to the aforementioned embodiment, the cushion ring 16 is disposed frontward of the interjacent element 20 within the housing 2; the washer 17 is disposed rearward of and adjacent to the cushion ring 16, such that the interjacent element 20 comes in contact with the washer 17 when the interjacent element 20 is caused to advance by the impactor 10's strike under no-load conditions; and the sleeve 18 is disposed rearward of and adjacent to the washer 17, such that the sleeve 18 positions the cushion ring 16 and the washer 17, and allows the interjacent element 20 to move rearward and frontward inside the sleeve 18. Accordingly, direct contact of the interjacent element 20 with the cushion ring 16 is avoided, and the cushion ring 16 can be located inside the tool holder 5 in place by the sleeve 18 without being press-fitted. Consequently, the stress imposed on the cushion ring 16 can be reduced, so that the durability of the cushion ring 16 can be increased to maintain the performance thereof for a longer period of time. Further, the durability of the other components which include the barrel 4 and the tool holder 5 can be ensured.

In this embodiment, particularly, the second cushion ring 23 is disposed between the sleeve 18 and the cylinder 6 such that the impactor 10 advancing under no-load conditions strikes the second cushion ring 23 indirectly, and the second cushion ring 23 is configured to position a rear end of the sleeve 18 indirectly. Consequently, the second cushion ring 23 can advantageously be utilized also for properly positioning the sleeve 18

Moreover, since the inner surface of the sleeve 18 is configured to serve as a guide surface on which the interjacent element 20 is slidable, the sleeve 18 can advantageously be utilized effectively for stably holding the interjacent element 20 within the tool holder 5. The present invention is advantageous particularly in a large electric hammer, like electric hammer 1 according to the present embodiment. Since the outside diameter of the interjacent element 20 is smaller than that of the cushion ring 16, and no recess for the bit 14 of which the rear end is inserted therein is formed at the front face of the interjacent element 20, the sleeve 18 can serve as a spacer for making up the gap between the cushion ring 16 and the interjacent element 20, which contributes effectively to the function of stably holding the interjacent element 20.

Furthermore, since the rear end of the bit 14 passes through the washer 17 when the bit 14 is installed into the tool holder 5, the bit 14 can stably be held by the washer 17 without wobbling circumferentially around the axis of the bit 14. Therefore, the washer 17 can be effectively utilized for maintaining the good striking performance.

It is to be understood that the cushion ring 16 and second cushion ring 23 are described as having a rectangular cross section and a substantially square cross section, respectively, by way of example only in the aforementioned embodiment, but the shock-absorbing element and/or second shock-absorbing element consistent with the present invention may be configured in any other structures; for example, a circular cross section ring or an oval cross section ring, or a plurality of rings arranged in the axial direction. Similarly, for the washer consistent with the present invention, a plurality of washers may be arranged in the axial direction, and the washer or washers may not necessarily be utilized for holding the rear end portion of the bit depending upon the state of the bit as installed. Furthermore, it may be possible to omit the front washer and to directly position the sleeve by the second cushion ring.

On the other hand, in the aforementioned embodiment, although the front end of the second cushion ring 23 is positioned at the front washer 22 supported by the rear end portion 25 of the tool holder 5, the front washer 22 for positioning the second cushion ring 23 may instead be supported by the sleeve 18 alone; for that purpose, the rear end portion 25 of the tool holder 5 may be designed to be shorter or the sleeve 18 may be designed to be longer. In this configuration, the second cushion ring 23 is positioned at the front washer 22 supported by the sleeve 18, the washer 17, and the cushion ring 16; therefore, impact of the impactor 10 advancing under no-load conditions is absorbed by the second cushion ring 23 and also by the cushion ring 16 located frontward, so that the synergetic effect can be achieved.

Any other changes or modifications may be made, where appropriate, to the interjacent element, the impactor, the housing, and other components. For example, the present invention may be applied to such an impact tool as described previously in which at a front face of an interjacent element is formed a recess in which a rear-end portion of the bit is to be inserted.

The invention claimed is:

1. An impact tool comprising:

a cylindrical housing having a bit-installable end;

a cylinder provided in a rear space within the housing, the cylinder incorporating a motor-driven reciprocating piston and an impactor that is provided frontward of the piston and configured to be moved in synchronization with the piston;

an interjacent element provided within the housing between the cylinder and a bit, and configured to be movable rearward and frontward in a predetermined stroke and to be pressed rearward into a retreated position by a rear end of a bit when the bit is installed, wherein the impactor reciprocating in synchronization with the piston is configured to strike the interjacent element so that the bit is indirectly struck;

a shock-absorbing element disposed frontward of the interjacent element within the housing;

a washer disposed rearward of the shock-absorbing element and adjacent to the shock-absorbing element, wherein the interjacent element is configured to come in contact with the washer when the interjacent element is caused to advance by the impactor's strike under no-load conditions, the no-load conditions comprising at least a condition where the impact tool is withdrawn from contact with a workpiece;

a sleeve disposed rearward of the washer, and adjacent to the washer, wherein the sleeve is configured to position the shock-absorbing element and the washer in place, and to allow the interjacent element to move rearward and frontward inside the sleeve; and a second shock-absorbing element disposed between the sleeve and the cylinder such that the impactor advancing under the no-load conditions strikes the second shock-absorbing element, wherein the second shock-absorbing element is configured to position a rear end of the sleeve indirectly with respect to the impactor.

2. The impact tool according to claim 1, wherein an inner surface of the sleeve is configured to serve as a guide surface on which the interjacent element is slidable.

3. The impact tool according to claim 1, wherein a rear end of the bit passes through the washer when the bit is installed into the housing, so that a rear-end portion of the bit is held by the washer.

4. The impact tool according to claim 1, wherein the shock-absorbing element comprises an annular part made of rubber.

5. The impact tool according to claim 1, further comprising:

a front washer disposed frontward of the second shock-absorbing element and adjacent to the second shock-absorbing element; and a rear washer disposed rearward of the second shock-absorbing element and adjacent to the second shock-absorbing element, wherein the interjacent element is configured to be movable rearward and frontward in the predetermined stroke defined by the washer and the front washer with which the interjacent element is brought into contact at frontmost and rearmost positions thereof, respectively.

6. The impact tool according to claim 5, wherein the interjacent element comprises a shaft which forms a rear portion of the interjacent element, the shaft having a reduced diameter and allowed to pass through the front and rear washers and the second shock-absorbing element, such that the shaft protrudes through the front and rear washers and the second shock-absorbing element into the cylinder when the interjacent element is in the retreated position where the interjacent element is in contact with the front washer, while the shaft protrudes through the front washer but fails to protrude into the cylinder when the interjacent element is in an advanced position where the interjacent element is in contact with the washer.

7. The impact tool according to claim 5, wherein the rear end of the sleeve is in contact with the front washer whereby rearward movement of the sleeve is restricted.

8. The impact tool according to claim 5, wherein the housing comprises:

a cylindrical barrel configured to hold the cylinder; and a tool holder disposed frontward of and coupled to the barrel, and configured to hold the bit.

9. The impact tool according to claim 8, wherein the tool holder has an inner surface shaped to provide a hexagonal hole and a cylindrical hole in front and rear portions of the tool holder, respectively, the hexagonal hole being configured to allow the bit to be disposed therein in such a manner that the bit is movable rearward and frontward inside the hexagonal hole, the cylindrical hole being coaxial with and larger in diameter than the hexagonal hole, to form a stepped portion at a joint part between the hexagonal hole and the cylindrical hole so as to prevent the shock-absorbing element from further moving frontward when the shock-absorbing is in contact with the stepped portion.

10. The impact tool according to claim 9, further comprising a retainer disposed perpendicularly to an axial direction of the tool holder in a front portion of the tool holder, the retainer being configured to be fitted in a recess that is formed in a periphery of the bit and extends in a front-and-rear direction, so as to hold the bit in such a manner that the bit is movable rearward and frontward.

11. The impact tool according to claim 8, wherein the second shock-absorbing element is positioned by the front washer being in contact with the tool holder and the rear washer being in contact with the barrel.

12. The impact tool according to claim 5, wherein the rear washer has an annular protrusion formed at a rear face thereof, the annular protrusion being configured to protrude into a front end portion of the cylinder to define a position at which the impactor is prevented from advancing further.

* * * * *